United States Patent [19]

Hamilton et al.

[11] Patent Number: 4,929,862

[45] Date of Patent: May 29, 1990

[54] SECURITY SHIELD FOR DISPLAY CASES

[76] Inventors: Gregory C. Hamilton; Danielle R. Hamilton, both of P.O. Box 2261, Chico, Calif. 95927

[21] Appl. No.: 302,051

[22] Filed: Jan. 25, 1989

Related U.S. Application Data

[63] Continuation-in-part of Ser. No. 209,007, Jun. 20, 1988, abandoned.

[51] Int. Cl.[5] ..... A47F 3/00

[52] U.S. Cl. ..... 312/138.1; 312/297; 312/215; 160/32

[58] Field of Search ..... 312/138 R, 297, 268, 312/299, 215, 219, DIG. 33, 117, 126, 138.1; 70/78; 160/32, 33, 37, 229.1, 235, 201

[56] References Cited

U.S. PATENT DOCUMENTS

| | | | |
|---|---|---|---|
| 917,705 | 4/1909 | Benjamin | 312/297 |
| 1,368,827 | 2/1921 | Neilson | 312/297 |
| 1,712,842 | 9/1923 | Richardson | 312/297 |
| 2,168,022 | 7/1938 | Drager | 312/297 |
| 2,336,660 | 12/1943 | West | 160/201 |
| 2,584,134 | 2/1952 | Knutson | 160/201 |
| 2,739,730 | 3/1956 | Jonas | 312/297 |
| 2,827,115 | 3/1958 | Stroup | 160/201 |
| 2,901,122 | 8/1959 | Edman | 312/297 |
| 3,351,405 | 11/1967 | Ferdinand et al. | 312/297 |
| 3,834,780 | 9/1974 | McClellan et al. | 312/215 |
| 4,413,489 | 11/1983 | Hogue | 312/297 |
| 4,432,591 | 2/1984 | Rinkewich | 312/297 |
| 4,470,444 | 9/1984 | Riexinger et al. | 160/235 |
| 4,793,397 | 12/1988 | Whiteman | 160/201 |

FOREIGN PATENT DOCUMENTS

| | | | |
|---|---|---|---|
| 2808177 | 8/1979 | Fed. Rep. of Germany | 160/235 |

*Primary Examiner*—Kenneth J. Dorner
*Assistant Examiner*—Brian K. Green

[57] ABSTRACT

A flexible shield panel is movably affixed between two U-shaped tracks and mounted in a jewelry store type glass top display case to protectively cover the jewelry display tray shelf. The U-shaped tracks are installed in the solid end walls of the display case with one longer track section horizontally positioned above the jewelry display tray shelf in close proximity to the shelf and the other longer track section below the display tray shelf. Elliptical discs attached by shafts to the edges of the flexible shield panel fit captively in interfaced lipped grooves which are track channels in the U-shaped track structure. The discs slide in the channel. In some applications, the discs can be sufficiently rounded and axled to turn in the track channel. The flexible shield panel is approximately half as long as the tracks and can be manually pulled along the tracks to an upward position closely covering a display tray of jewelry on the display tray shelf. The flexible shield panel can be pushed to a downward storage position. Key operated protruding lock rods are provided to lock the flexible shield panel securely in the upward position covering any jewelry on the display tray shelf.

10 Claims, 4 Drawing Sheets

SECURITY SHIELD FOR DISPLAY CASES

The present application is a continuation-in-part of application Ser. No. 07/209,007, filed June 20, 1988, now abandoned.

BACKGROUND OF THE INVENTION

1. Field of the Invention:

This invention relates to security devices for glass top jewelry and merchandise display cases. The present invention is particularly directed towards a shielding device which can be closed over the top of a jewelry display and locked inside the display case. The present invention is also directed towards a structure which can be added to an existing display case or installed in a glass top display case as part of the manufacturing process.

2. Description of the Prior Art:

Even with the use of sophisticated security systems, merchants have experienced a rise in the theft of their merchandise over the past few years. This is particularly true in the jewelry business. Although security alarm systems indicate the present of an intruder, the lapse of time between the activation of the alarm and the arrival of the police leaves the intruder with several minutes to break the glass tops of display cases, grab the merchandise and escape before the police arrive. These "three minute" burglaries are a serious problem for retailers who display precious merchandise such as jewelry or coins and the like. Many retailers leave a significant amount of their merchandise in the display cases overnight, due to limited vault space or the time consuming task of transferal. Most of the glass display cases presently in use contain rear locking doors which have proven to be of little use for securing an unguarded glass case after the business has closed. The upper glass portion of the case can be easily broken and the merchandise stolen, in many cases, within three minutes. To examine past art patents containing lockable display cases and installable security devices, a search was conducted in the following classes and subclasses:

312/25, 39, 137, 132, and 297.

Patents examined which appeared to us to be the most pertinent to our invention include the following:

Benjamin was issued U.S. Pat. No. 917,705, on Apr. 6, 1909, for a locking display stand.

Neilson was issued U.S. Pat. No. 1,368,827, on Feb. 15, 1921, for a lockable money counter's desk.

Richardson was issued U.S. Pat. No. 1,712,842, on May 14, 1929, for a desk drawer lock.

On Aug. 1, 1939, Drager was issued U.S. Pat. No. 2,168,022, for a flexible see-through screen.

On Aug. 25, 1959, Edman was issued U.S. Pat. No. 2,901,122 for "Display Devices".

U.S. Pat. No. 4,413,489, was issued to Hogue on Nov. 8, 1983, for a furniture lock.

Rinkewich was issued U.S. Pat. No. 4,432,591, on Feb. 21, 1984, for a storage and transport cart with improved security.

Two of the past art devices teach locking shields which store in view of customers when not in use. U.S. Pat. No. 917,705 discloses a shield which hangs over the back of the display stand when not in the locked position. This limits the use and access of available space under the stand, and puts the shield in a position where it could be damaged. Positioning the unlocked shield in this manner leaves the unsightly shield in view of customers giving the case an undesirable marketing appearance.

U.S. Pat. No. 4,432,591 shows a shield which only partially rolls out of sight when not in use. Aesthetics of display cases, and conservation of space are important factors to merchandisers.

Several devices, including U.S. Pat. Nos. 917,705, 1,712,842, 2,168,022, 2,901,122, and 4,413,489, disclose security roll top shields. The edges of these roll top shields set in U-shaped guide-tracks which overlap the edges of the shield slightly. A guide-track structure as such, would allow the shield if kicked or beaten with a hammer in the middle section, to bow inward, shortening the shield widthwise causing it to be pulled out of the track.

The following past art patents provide only a single locking means for their devices; U.S. Pat. Nos. 917,705, 1,386,827, 2,168,022, 2,901,122, 4,413,489, and 4,432,591. Should the lock provided with these devices be pried open, then easy entry into the interior of the case is made.

U.S. Pat. Nos. 917,705, 1,368,827 and 2,168,022, provide containers or cases having security roll top shields which are specifically designed to be partially or completely transparent. A thief would be able to see what was locked inside such a case and would spend his time gaining access into only those cases containing valuables.

Security devices seen in the past art singularly or in restructured combinations would not be practical if substituted for our invention. The past art devices would require considerable alterations and modifications, none of which were anticipated in their specifications or mentioned in their claims. No past art devices provide locking means specifically designed for a glass display case utilizing a roll top security locking shield. U.S. Pat. No. 2,168,022, does provide a roll top locking shield constructed of transparent glass or plastic, however a glass shield could be easily shattered. If a glass plate were added above the shield in U.S. Pat. No. 917,705, the shield would still be stored in sight and in the way. U.S. Pat. Nos. 1,368,827, 1,712,842, and 4,432,591, could not be effectively used as display cases since entry or use of the interior of the container would be obstructed, therefore the use and intent of their devices as a money counters desk, an office desk, and a mobile utility cart, respectively, would be lost.

We feel our invention overcomes the heretofore mentioned disadvantages, and provides new and unique features not found in the past art devices. These unique features are pointed out and fully discussed in the following specification.

SUMMARY OF THE INVENTION

Our invention provides a security shield which can be added to an existing display case or incorporated into a display case during manufacturing. The invention is primarily directed towards jewelry display cases which have glass tops, glass fronts, and solid ends; but the device can be used in a variety of similarly structured merchandise display cases. The security shield of the present invention is comprised of two U-shaped tracks set edgewise vertically positioned in parallel alignment oppositely fastened to the end walls inside a glass top jewelry case. The longer sections of the U-track are horizontally inclined one above the jewelry display tray shelf and one below the display tray shelf. The track above the display tray shelf is positioned low, close to the jewelry stored in the display tray on the display tray shelf. Each track has lipped groves along one side. The lipped grooves are interfaced towards each other forming track captive retainer channels. The retainer channels are sized to allow disc sliders or round turning discs to pass along. A flexible shield panel is formed of a plurality of narrow metal or plastic slats hingedly attached longitudinally to each other. The slats may be single piece but are preferably structured of two attached semi-round paralleling members with edges attached to form two convex surfaces with a small space between the edge-attached members. The flexible shield panel is movably affixed with the hinged slats crosswise between the U-shaped tracks by axle-like shafts attached to widened elliptical discs or rounded wheel-like disc members fitting captively in lipped grooves of the U-shaped tracks. The width of the flexible shield panel is congruous with the length of the slats and the length is the sum of the slat widths. The length of the flexible shield can be shortened by removing slats. In width, the flexible shield panel is usually manufactured to the size required. The flexible shield panel length is approximately half the track length and can be pulled manually along the track to cover an upwardly section from the apex of the U-curve to the terminal upwardly track ending. In this position, a jewelry display tray on a display tray shelf placed somewhat upwardly centrally between and paralleling the horizontal U-track members could be completely covered. The upper track section being low brings the shield panel in close proximity to the jewelry tray shelf. This positioning makes smashing down the shield to pull out the track attachment discs most difficult. The U-track is supported by attachment inside to the ends of a jewelry display case, usually wood, with the low positioned half of the straight track above the display tray shelf, the rounded sections through an opening in the display tray shelf adjacent the access door, and the remaining half of the straight track extending inward under the tray shelf. The flexible shield panel is locked shut by a key turned lock which extends rod ends contained within the end slat in the flexible shield panel into receiving apertures in the U end of the U-shaped track. Other means of locking may be used. When unlocked and not in use, the flexible shield panel can be pulled out of sight into the lower horizontal track below the display tray shelf.

Our security shield can also be built into a display case during manufacturing of the case. The U-shaped track structure lends itself readily to be fitted into grooves routed in the end panels of the case. The security shield can then be assembled as the case is being assembled.

Therefore, it is a primary object of our invention to provide a lockable security shield for framed glass display cases providing internal means for protecting the merchandise inside the case from theft.

A further object of the invention is to provide a security shield for display cases which is quick and easy to use and convenient to store when not in use.

An even further object of the invention is to provide a security shield for display cases which is opaque and prevents the viewing of the covered merchandise.

A still further object of our invention is to provide a security shield for display cases which provides means of preventing the ends of the shield retained within the guide tracks from being forced out.

Another object is to provide a security shield for display cases having a locking means conveniently located for authorized personnel to operate, and inconveniently located for thieves to defeat.

An even further object of our invention is to provide a security shield for display cases which retains the aesthetic appearance of the display case by being stored completely out of sight when not in use.

A still further object of our invention is to provide a security shield for display cases which is resistant to intrusion with blunt instruments such as hammers or heavy weights.

Other objects and advantages of our invention will prove evident with a reading of the numbered parts described in the specification with reference to similarly numbered parts shown in the accompanying drawings.

DRAWING REFERENCE NUMBERS

Figure 1:
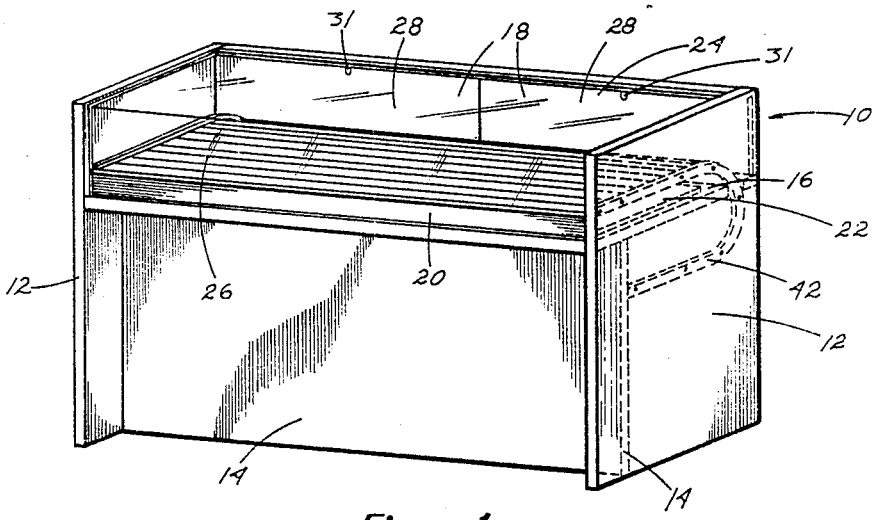
FIG. 1 illustrates the security shield of the present invention assembled and mounted in a display case covering displayed merchandise. The left side of the display case is shown having a side panel of solid material. The mounted guide track is represented with dotted lines as it would appear if the solid panel were transparent.

10: display case
12: side panels
14: front panel
16: display tray shelf
18: back section
20: narrow front panel
22: display tray
24: top glass panel
26: front glass panel
28: doors
30: lock
31: latch
32: shield passage
34: flexible shield panel
36: slats
37: elliptical discs
38: slat hinging attachments
40: track captive retainer channels
42: U-shaped tracks
44: slat lock
46: lock rods
48: lock rod retaining apertures
50: jewelry
52: track mount apertures
54: mounting screws
56: upper slat member
58: lower slat member
60: attachment weld
62: slat end plate
64: axle slot
66: axle rod
68: fixed axle rod retainer
70: square axle rod
72: round discs
74: round axle rod
76: circled section
78: lipped grooves

DESCRIPTION OF THE PREFERRED EMBODIMENT

Referring now to the drawings and to FIG. 1 where the preferred embodiment of the invention is shown and here described in the assemblage of a jewelry display case. Jewelry display cases as illustrated are in general use in jewelry stores and the immediate invention has been developed primarily for this type of case. The jewelry case described is designated display case 10. The structure includes: Side panels 12, usually of solid wood, supporting the ends of the case. Front panel 14 is recessed so customers have some leg room to sit while viewing display tray 22 on which the merchandise such as jewelry 50 (FIG. 4) is displayed. Display tray 22 is removable and is supported by display tray shelf 16. Back section 18 is illustrated open but may have shelves and drawers installed. For viewing, display case 10 has a top glass panel 24 and a front glass panel 26. Doors 28 open from the top and swing downward at the back of the case. Doors 28 are held closed by latch 31 in the top of the case and can be locked by lock 30.

Figure 2:
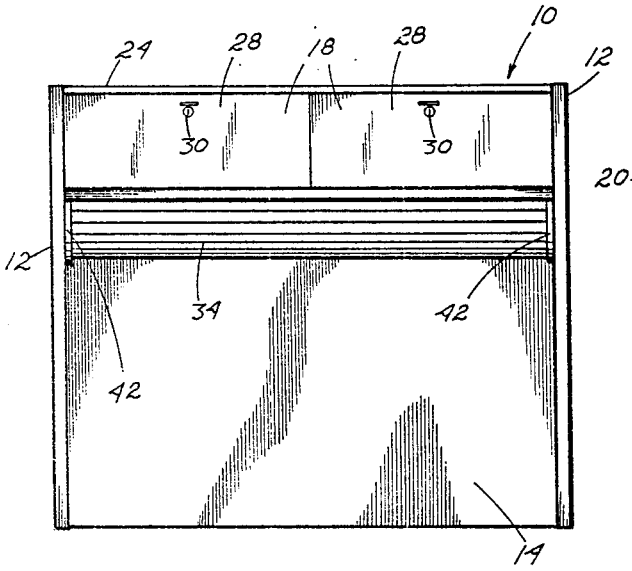
FIG. 2 is a rear view of the display case and the mounted security shield with the security shield in the stored position below the display tray shelf.
Figure 3:
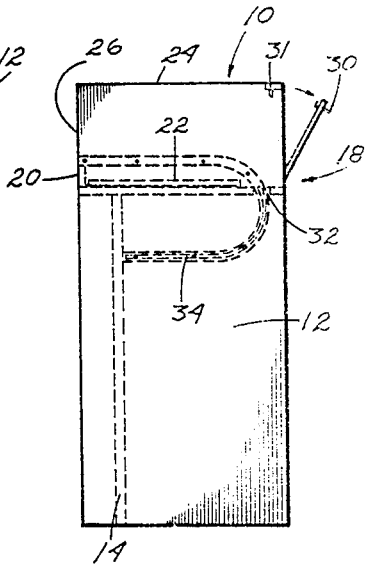
FIG. 3 is a left side view of the display case. The security shield and guide track are depicted by the U-shaped dotted outline. The flexible shield panel is in the non-use storage position.
Figure 9:
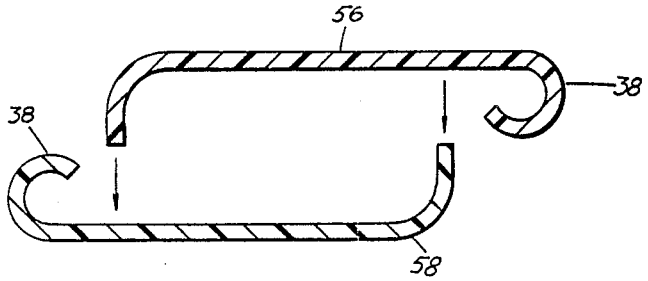
FIG. 9 is a sectional end view of plastic slat members prior to assembly with one slat member positioned over the other ready for attachment to form double membered slats.
Figure 10:
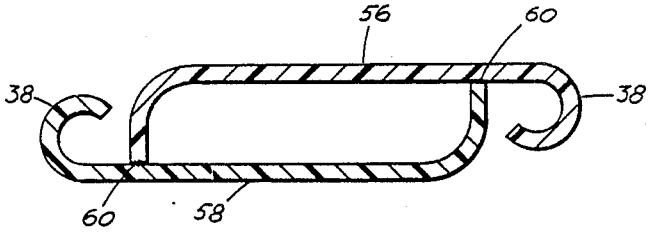
FIG. 10 is a sectional end view showing the plastic slat members forming individual assembled slats.

The security shield constituting the present invention, shown installed in FIG. 1, 2, and 3, comprises flexible shield panel 34 affixed movably between two U-shaped tracks 42. U-shaped tracks 42 are positioned oppositely in parallel alignment with the U sideways and having the longer track sections horizontally positioned one above in close proximity to display tray shelf 16 and one below with the greater part of the track section below the display tray shelf 16. U-shaped tracks 42 are fastened inside to side panels 12 by mounting screws 54 through track mount apertures 52. The interfaced track sides have lipped grooves 78 opened towards each other to form track captive retainer channels 40. Track captive retainer channels 40 provide an opened passageway along the inner sides of U-shaped tracks 42. See the exploded view at FIG. 7. Flexible shield panel 34 is comprised of a plurality of single slats 36 structured of double members attached longitudinally one over the other along inwardly curved edges. Upper slat member 56 is fastened by attachment weld 60 along a downwardly curved terminal end to the inner surface of lower slat member 58. Lower slat member 58 is fastened to the inner surface of upper slat member 56 along an upwardly curved terminal end by attachment weld 60. See FIG. 9 and FIG. 10. Slat hinging attachments 38 are oppositely curved longitudinal edges of slats 36. During assemblage of flexible shield panel 34, slats 36 are slid longitudinally attaching slat hinging attachments 38 together. After locking, slats 36 are readily pivotal but will not separate by transversal manipulation. Flexible shield panel is congruous in width to the length of slats 36 and in length to the sum of the widths of slats 36. Slats 36 can be separated for shortening or lengthening flexible shield panel 34 by sliding slats 36 lengthwise releasing slat hinging attachments 38 and removing slats 36 or adding slats 36. It would be obvious to one skilled in the art that slats 36 could be manufactured as described and by a number of different methods. For example slats 36 could be extruded from a single piece of material. Slats 36 could also be used effectively in flexible shield panel 34 as one-piece slats without a hollow center core.

Figure 7A:
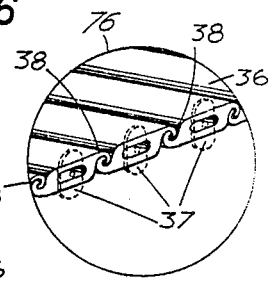
FIG. 7A is an enlargement of circled section 76 in FIG. 7 showing the end capping and hinging structure of the flexible shield and, in dotted lines, showing the track fitting disc attachments having axle-like shafts.
Figure 7:
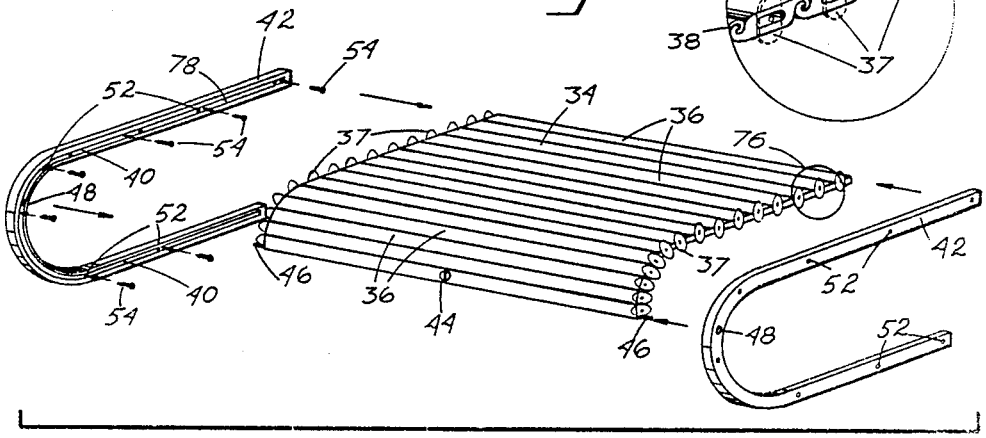
FIG. 7 is an exploded view of the shield and U-shaped track structure showing the interfaced lipped grooves in the two parallel sections of the guide tracks with fasteners and the flexible shield panel with lock and disc track attachments.
Figure 11:
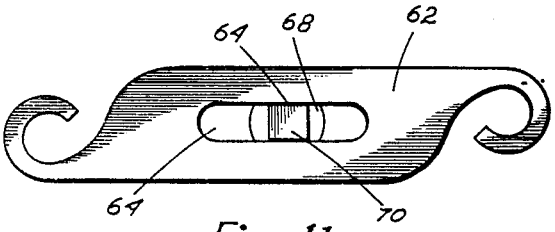
FIG. 11 is a side view of the slat end plate showing the axle slot with the square axle rod inserted.
Figure 12:
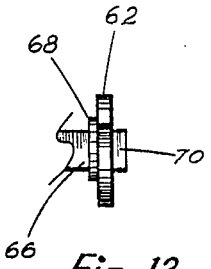
FIG. 12 shows the slat end plate and square axle of FIG. 11 in an edge view and illustrates a tight washer-like fixed axle rod retainer.
Figure 13:
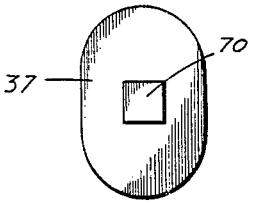
FIG. 13 illustrates an elliptical disc slider affixed to a square axle rod in a frontal view.
Figure 14:
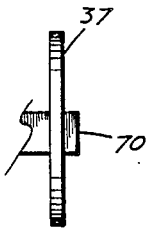
FIG. 14 is a side view of the elliptical disc slider.

Slat end plate 62 attaches by weld to and covers the ends of slats 36 maintaining upper slat member 56 and lower slat member 58 and providing an axle support structure as shown in FIG. 7 and in the circled section 76, enlarged at FIG. 7A. The attachment and form of slat end plate 62 is also illustrated in a frontal view at FIG. 11 and in an end view at FIG. 12. Square axle rod 70 passed through axle slot 64 retains elliptical disc 37. Elliptical discs 37 are fixed sliders and are prevented from turning but have limited back and forth movement in axle slot 64 which is an elongated slot. The limited back and forth movement provided by the elongation of axle slot 64 allowing flexible shield panel 34 to follow the curves in U-shaped tracks 42 in near proximity with slats 36 closely coupled by slat hinging attachments 38. Round axle rod 74 is used when round discs 72 are installed. Although round discs 72 do turn, they also have limited back and forth movement in axle slot 64.

Figure 15:
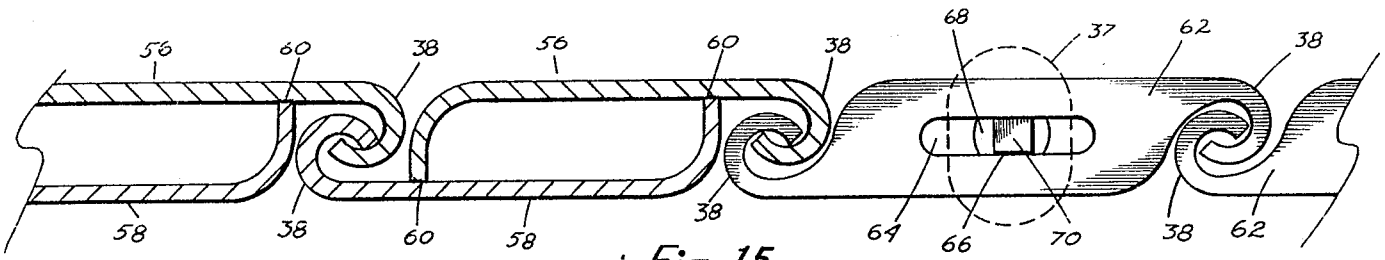
FIG. 15 is a partial side view of the flexible shield panel with the slats hinged-locked together by oppositely curved extensions of the individual slat members and illustrating the flexible shield panel in a metal fabrication in a sectional view.
Figure 16:
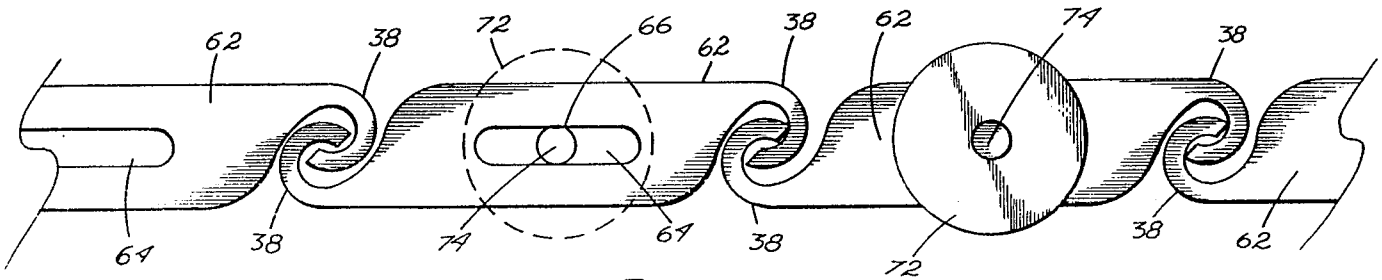
FIG. 16 is a side view of the assembled slats hingedly locked together by oppositely curved longitudinal extensions with slat end plates attached and illustrating round turnable discs attached by round axle rods.

Axle back and forth movement allows slats 36 some repositioning keeping the edges of flexible shield panel 34 closely aligned with U-shaped tracks 42. Fixed axle rod retainer 68 is a washer, tightly fastened to axle rod 66 inside between slat members 56 and 58 against slat end plate 62 is the keeper which holds elliptical discs 37 and round discs 72 operational and properly positioned. The structure is illustrated in FIG. 11, 12, 13, and 14. Elliptical discs 37, which operate like rounded fixed sliders, illustrated in FIG. 7, are shown in a frontal view in FIG. 13 and in an end view in FIG. 14. In FIG. 15, flexible shield panel 34 is shown assemblage. FIG. 15 also illustrates a metallic embodiment of flexible shield panel 34. FIG. 16 illustrates the assembled slats 36 hingedly locked by slat hinge attachments 38 with round discs 72 affixed to round axle rod 74. It is noted that axle rod 66 is that portion of the axle inside of slat end plate 62. The disc attachment ends of axle rod 66 can be formed into squared axle rod 70 or round axle rod 74.

Figure 8:
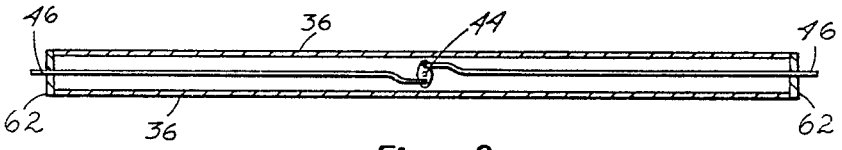
FIG. 8 is a cross sectional view of the first flexible shield panel illustrating double member slat structure housing the locking mechanism and showing a key turned rod for bolt-type locking the ends of the flexible shield into the track wall.

Flexible shield panel 34 is movably fastened with slats 36 longitudinally crosswise between U-shaped tracks 42 by elliptical discs 37. Elliptical discs 37 are movably fitted into the lipped grooves 78 of track captive retainer channels 40 and are affixed along the attachment edges of flexible shield panel 34 to hold flexible shield panel 34 movably retained in U-shaped tracks 42. The disc attachment is illustrated in the enlargement at FIG. 7A in the drawings. In most applications, the discs are elliptical in shape, do not turn on the shafts, and are arranged to slide in track captive retainer channels 40 with the major diameter of the disc vertically aligned. Elliptical discs 37 can however be replaced by round discs 72 arranged to rotate on round axle rods 74 in the lipped grooves 78 of track captive retainer channels 40. The drawings at FIG. 1 and FIG. 3 illustrate the positioning of U-shaped tracks 42. The curved section of U-shaped tracks 42 passes around the short cut end of display tray shelf 16 and that opening is designated shield passage 32. Shield passage 32 is important in that it allows flexible shield panel 34, which is about half as long as U-shaped tracks 42, to be manually pulled along the track to an upwardly display shelf-covering position and moved back along the track to a downwardly concealed position when not in use. Shield passage 32 also makes room so case doors 28 can be closed and locked. The position of slat lock 44, which is the key locking device for flexible shield panel 34, is shown in FIG. 7 and in detail in FIG. 8. Slat lock 44 is a twist key lock enclosed in the end slat section of flexible shield panel 34 as shown in FIG. 8. Turning slat lock 44 moves lock rods 46 in and out of lock rod retaining apertures 48 in U-shaped tracks 42.

Figure 4:
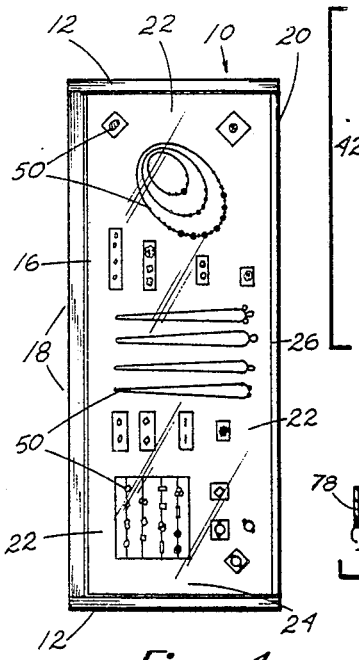
FIG. 4 is a top view of the display case with displayed jewelry illustrating how the shield is out of view when use.
Figure 5:
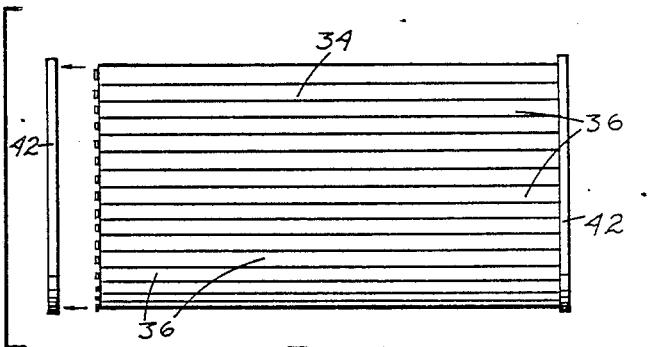
FIG. 5 is a top plan view of the top section of the guide track and a top plan view of the hinged slat flexible shield panel illustrating the guide track attached to the flexible shield panel at one end and ready for attachment at the other end.
Figure 6:
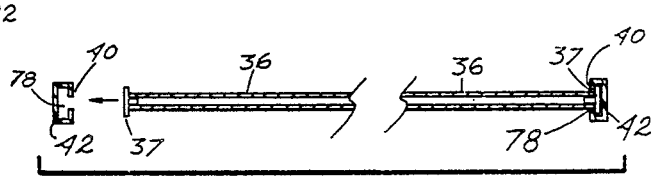
FIG. 6 is a cross sectional view of one guide track end showing the lipped groove captive retainer slot and in a cross sectional view of the flexible shield panel, the double walling of the panel is illustrated with an attachment disc at one end and the disc in the captive track retainer slot.

FIG. 1 illustrates flexible shield panel 34 in the on-top locked protective position over display tray shelf 16 covering display tray 22. The closeness of flexible shield panel 34 to display tray shelf 16 restricts the distance flexible shield panel 34 can be pushed downwards in any attempt to force the disc attachments out of track captive retainer channels 40. In FIG. 2 and FIG. 3 flexible shield panel 34 is in the down or storage position. When flexible shield panel 34 is in the storage position, full viewing of jewelry 50 through the described glass panels with flexible shield panel 34 completely out of the way is accomplished, see FIG. 4. In FIG. 5 and FIG. 6 in a top and an end sectional view of U-shaped tracks 42 and flexible shield panel 34, the attachment of elliptical discs 37 into track captive retainer channels 40 of U-shaped tracks 42 is illustrated. The discs are in the channel and the axle-like shafts pass through the channel opening and attach to flexible shield panel 34 through axle slot 64 in slat end plate 62.

In use, when a store is ready to close for the night, jewelry 50 in display case 10 can be covered and secured in a manner discouraging break-through theft. Flexible shield panel 34 is pulled up along U-shaped tracks 42 to a position above but in close proximity to display tray 22. A key in slat lock 44 turns lock rods 46 into lock rod retaining apertures 48. As slat lock 44 is locked inside the case doors 28 by lock 30, the contents of display case 10 is doubly secured. Breaking top glass panel 24 is the only quick way to the case content as narrow front panel 20 in the front of display case 10 discourages frontal entrance. Flexible shield panel 34 is positioned low over display tray shelf 16 and is designed to withstand assault by hammering and prying after glass break-through sufficiently to prevent the so called "three-minute burglary." This is the time element normally required for sophisticated burglary alarm systems to activate and police to arrive. The purpose of a multiple of elliptical discs 37 positioned long-diameter vertical to slide in the track channel and not turning on the axle-like shaft makes disengagement of the discs from the track channel more difficult to accomplish.

During business hours, flexible shield panel 34 can be unlocked and pulled down along U-shaped tracks 42 to a concealed position below display tray shelf 16. This storage positioning of flexible shield panel 34 is illustrated in FIG. 2, FIG. 3 and FIG. 4 of the drawings.

Although we have described our invention with considerable details in the specification, it is to be understood that we may make modifications in the design and changes in the structure so long as changes made do not exceed the intended scope of the appended claims.

The embodiments of the invention in which an exclusive property or privilege is claimed are defined as follows:

1. A display case comprising a glass top, a front panel, a pair of side panels, and a display tray shelf attached to the said panels directly below said glass top;

said display tray shelf having a shield passage opening formed therein;

a U-shaped track attached to each side panel in such a way that each said U-shaped track passes through the said shield opening in the display tray shelf so that a portion of each said U-shaped track appears above the tray shelf and another portion of each said U-shaped track appears below the tray shelf, said U-shaped tracks each opened along one full side with lipped grooves;

means for mounting said U-shaped tracks to the side panels with said U-shaped tracks in parallel alignment and said lipped grooves interfaced;

a plurality of slats, each said slat having means that hingedly connect the slats longitudinally together to form a flexible shield panel;

said flexible shield panel having means for attaching the shield panel to the U-shaped tracks and allows the shield panel to move along said U-shaped tracks between an on-top protective position covering said display tray shelf to a storage position which is below the display tray shelf, said flexible shield panel passing through the shield passage opening when moving from the protective position to the storage position;

and means for locking said flexible shield panel when in said protective position.

2. The display case of claim 1 wherein said attachment means for affixing said flexible shield panel to said interfaced lipped grooves in said U-shaped tracks includes square shafts affixed to elliptically shaped discs arranged to slide in said interfaced lipped grooves in said U-shaped tracks.

3. The display case of claim 1 wherein said attachment means for affixing said flexible shield panel to said interfaced lipped grooves in said U-shaped tracks includes round axles and round discs arranged to turn when moved in said U-shaped tracks.

4. The display case of claim 1 wherein said means for mounting said U-shaped tracks includes mounting apertures in said U-shaped tracks and mounting screws.

5. The display case of claim 1 wherein said flexible shield panel, said pair of U-shaped tracks, and said attachment means are manufactured of plastic.

6. The display case of claim 1 wherein said flexible shield panel, said pair of U-shaped tracks, and said attachment means are manufactured of metal.

7. The display case of claim 1 wherein said slats are fabricated by extrusion from a single piece of material.

8. The display case of claim 1 wherein each said slat is a structural arrangement of an upper member and a lower member welded at oppositely curved ends to form a single said slat.

9. The security shield of claim 1 wherein said attachment means includes a plate attached at each end of the slats, each said plate having a slot formed therein.

10. The security shield of claim 1 wherein said means for locking said flexible shield panel includes moveable rods affixed in longitudinal parallel alignment along an inside edge of a terminally positioned slat with said movable rods having retractable ends protruding out from ends of said slat, said retractable ends removably fitting into apertures in said tracks, with said rods affixed to a top and to a bottom of a key turn lock, said key turn lock is attached centrally to said terminally positioned slat and said terminally positioned slat is positioned at one end of said flexible shield panel.

* * * * *